US011854487B1

(12) United States Patent
Zhou et al.

(10) Patent No.: US 11,854,487 B1
(45) Date of Patent: Dec. 26, 2023

(54) PIXEL DRIVE CIRCUIT, DISPLAY PANEL, AND DISPLAY DEVICE

(71) Applicant: HKC CORPORATION LIMITED, Shenzhen (CN)

(72) Inventors: Xiufeng Zhou, Shenzhen (CN); Xin Yuan, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/068,024

(22) Filed: Dec. 19, 2022

(30) Foreign Application Priority Data

Jun. 28, 2022 (CN) ..... 202210739300.6

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/043* (2013.01); *G09G 2300/0819* (2013.01); *G09G 2320/0233* (2013.01)

(58) Field of Classification Search
CPC ..... G09G 3/3233; G09G 2300/0842; G09G 2300/0819; G09G 2300/0861; G09G 2300/0426; G09G 2300/0852; G09G 2300/043; G09G 2320/0233; G09G 2320/043; G09G 2320/045; G09G 2320/0247; G09G 2310/0251
See application file for complete search history.

(56) References Cited

U.S. PATENT DOCUMENTS

| | | | | |
|---|---|---|---|---|
| 10,916,197 | B1 | 2/2021 | Zhang | |
| 2018/0130418 | A1* | 5/2018 | Zhu | H01L 29/78648 |
| 2018/0233082 | A1 | 8/2018 | Wang et al. | |
| 2019/0164476 | A1* | 5/2019 | Feng | G09G 3/3233 |
| 2020/0258452 | A1 | 8/2020 | Feng et al. | |
| 2021/0407383 | A1 | 12/2021 | Lai et al. | |
| 2022/0122522 | A1* | 4/2022 | Li | G09G 3/2092 |
| 2022/0415273 | A1* | 12/2022 | Chen | G09G 3/3611 |

(Continued)

FOREIGN PATENT DOCUMENTS

| | | | |
|---|---|---|---|
| CN | 105741779 | A | 7/2016 |
| CN | 107358915 | A | 11/2017 |
| CN | 111210765 | A | 5/2020 |

(Continued)

*Primary Examiner* — Dong Hui Liang
(74) *Attorney, Agent, or Firm* — Maier & Maier, PLLC

(57) ABSTRACT

A pixel drive circuit, a display panel and a display device. The pixel drive circuit includes a drive transistor, a first compensation capacitor, and a second compensation capacitor. The drive transistor has a first control end, a second control end, an output end, and an input end. The drive transistor is configured as a four-terminal drive device having two control ends, and between each control end and the output end, a compensation element is arranged, so that the compensations to the threshold voltage of the front and rear channels are performed simultaneously when the drive transistor is driven. Meanwhile, each control end is equipped with a capacitor to eliminate the influence of a current difference caused by the threshold voltage of the secondary channel in the 4-terminal device.

17 Claims, 3 Drawing Sheets

(56) References Cited

U.S. PATENT DOCUMENTS

2023/0116711 A1* 4/2023 Wu ..... H10K 59/1213
345/204

FOREIGN PATENT DOCUMENTS

| | | | |
|---|---|---|---|
| CN | 112397029 | A | 2/2021 |
| CN | 113937157 | A | 1/2022 |
| CN | 114664253 | A | 6/2022 |
| KR | 20140080728 | A | 7/2014 |
| KR | 20160018892 | A | 2/2016 |

* cited by examiner

PIXEL DRIVE CIRCUIT, DISPLAY PANEL, AND DISPLAY DEVICE

CROSS-REFERENCE TO RELATED APPLICATION

Pursuant to 35 U.S.C. § 119 and the Paris Convention, this application claims the benefit of Chinese Patent Application No. 202210739300.6 filed on Jun. 28, 2022, the content of which is incorporated herein by reference.

FIELD

The present application relates to the field of display technology, and in particular, to a pixel drive circuit, a display panel and a display device.

BACKGROUND

The statements provided herein are merely background information related to the present application, and do not necessarily constitute any prior arts. With the development of the field of liquid crystal display, the advantages of the organic light-emitting display (OLED) display technology, such as self-luminous, thin and lightness, have gradually been widely used in TV, mobile phones, notebooks and other products. Because the OLED is a current-driven deice, when the threshold voltage Vth of the thin film transistor (TFT) shifts, the current drive of OLED will not be stable and will change, resulting in uneven brightness. Currently, the current compensation is performed by a drive-compensation circuit. The drive-compensation circuit includes a TFT and a capacitor, the TFT is connected to a sub-pixel element. The control end of the TFT is coupled to a data voltage, the input end of the TFT is coupled to a drive voltage, and the capacitor is connected between the output and control ends of the TFT, so that the voltage input into the sub-pixel element can be regulated through a control of the data voltage. An operation process of the pixel drive circuit includes four phases, i.e., a reset phase, a compensation phase, a writing phase and a light-emitting phase. Due to fluctuations in the process, the threshold voltages may be different, that is, the switch-on currents through the channel may be different. The influence on threshold voltage of the conductive channel formed by the device itself may be eliminated through an internal compensation circuit, but the conventional drive-switch-compensation scheme using 3-terminal devices has been developed to a certain extent, resulting in an insurmountable bottleneck, so it is urgent to provide a compensation scheme that can overcome the above bottleneck.

SUMMARY

The present application provides a pixel drive circuit, a display panel and a display device, aiming to broke through the insurmountable bottleneck in the exemplary technology, as the conventional drive-switch-compensation schemes using 3-terminal devices has been developed to a certain extent, resulting in an insurmountable bottleneck.

In accordance with a first aspect of the embodiments of the present application, a pixel drive circuit is provided, which is applied to a display panel. The display panel includes a plurality of pixels, each pixel includes a plurality of sub-pixel elements, and the pixel drive circuit includes a drive circuitry, a data-writing circuitry and a compensation circuitry.

The drive circuitry includes a drive transistor and a storage capacitor, the drive transistor includes an input end, an output end, a first control end and a second control end, the input end of the drive transistor is coupled to a drive-voltage terminal, and the output end of the drive transistor is coupled to a sub-pixel element, one end of the storage capacitor is coupled to the drive-voltage terminal, and the other end of the storage capacitor is coupled to the output end of the drive transistor.

An output end of the data-writing circuitry is coupled to the first control end of the drive transistor. The data-writing circuitry is configured to write a data voltage to the first control end of the drive transistor in a writing phase.

The compensation circuitry includes two compensation elements, one of the two compensation elements is coupled between the output end and the first control end of the drive transistor, to compensate a potential at the first control end of the drive transistor; and the other one of the two compensation element is coupled between the output end and the second control end of the drive transistor, to compensate a potential at the second control end of the drive transistor.

In an optional embodiment, each of the two compensation elements includes a compensation capacitor. The compensation capacitor included in one of the two compensation elements has one end being coupled to the output end of the drive transistor, and another end being coupled to the first control end of the drive transistor. The compensation capacitor included in the other one of the two compensation element has one end being coupled to the output end of the drive transistor, and another end being coupled to the second control end of the drive transistor.

In an optional embodiment, the data-writing circuitry includes a data-writing control transistor. The data-writing control transistor includes an input end, an output end and a control end. The control end of the data-writing control transistor is coupled to a first gate-control-signal line, the input end of the data-writing control transistor is coupled to a data-voltage terminal, and the output end of the data-writing control transistor is coupled to the first control end of the drive transistor.

In an optional embodiment, the data-writing circuitry includes a data-writing control transistor. The data-writing control transistor includes an input end, an output end, a first control end and a second control end. The input end of the data-writing control transistor is coupled to the data-voltage terminal, and the output end of the data-writing control transistor is coupled to the first control end of the drive transistor, the first control end of the data-writing control transistor is coupled to the first gate-control-signal line, and the second control end of the data-writing control transistor is coupled to a DC-voltage line.

In an optional embodiment, the pixel drive circuit also includes an input control transistor. A control end of the input control transistor is coupled to an emission-signal line, an input end of the input control transistor is coupled to the drive-voltage terminal, an output end of the input control transistor is coupled to the input end of the drive transistor, so that the input end of the drive transistor is coupled with the drive-voltage terminal.

In an optional embodiment, the pixel drive circuit also includes a reset circuitry. The reset circuitry is configured, in response to a reset-response voltage output from a reset-response-voltage line, to pull down a voltage at one end of the storage capacitor coupled to the output end of the drive transistor Tm to a reset voltage.

In an optional embodiment, the reset circuitry includes a reset transistor. A control end of the reset transistor is coupled to a second gate-control-signal line, an input end of the reset transistor is coupled to a reset-voltage line, and an output end of the reset transistor is coupled to the output end of the drive transistor;

Or alternatively, the reset circuitry includes a reset transistor. The reset transistor includes two control ends, one control end and an input end of the reset transistor are coupled to the reset-voltage line, the other control end of the reset transistor is coupled to the second gate-control-signal line, and an output end of the reset transistor is coupled to the output end of the drive transistor.

In an optional embodiment, the pixel drive circuit also includes a flip-elimination circuitry. The flip-elimination circuitry includes a flip-elimination transistor, a control end of the flip-elimination transistor is coupled to a third gate-control-signal line, an input end of the flip-elimination transistor is coupled to a reference-voltage terminal, and an output end of the flip-elimination transistor is coupled to the control end of the drive transistor, and wherein the flip-elimination transistor is configured to write a reference voltage to the control end of the drive transistor before the writing phase.

In accordance with a second aspect of the embodiments of the present application, a pixel drive method is provided. The pixel drive method includes steps of: charging the first compensation element and the second compensation element through the input end of the drive transistor, in the compensation phase, to raise the potential at the output end of the drive transistor to a difference between the potential at the control end of the drive transistor and the threshold voltage of the drive transistor; and switching on the drive transistor to form a conduction between the drive-voltage terminal and the sub-pixel element, in the light-emitting phase, to drive the sub-pixel element to emit light.

In accordance with a third aspect of the embodiments of the present application, a display panel is provided, which includes the pixel drive circuit as described above.

In accordance with a fourth aspect of the embodiments of the present application, a display device is provided, which includes the display panel and the pixel drive circuit as above-described. The display panel includes a plurality of pixels, and each pixel includes a plurality of light emitting devices.

It can be seen from the above solutions that, in the pixel drive circuit, the display panel and the display device provided by the present application, the drive transistor is configured as a four-terminal drive device having two control ends, and between each control end and the output end, a compensation element is arranged, so that the compensations to the threshold voltage of the front and rear channels are performed simultaneously when the drive transistor is driven. Meanwhile, each control end is equipped with a capacitor to eliminate the influence of a current difference caused by the threshold voltage of the secondary channel in the 4-terminal device. The configuration scheme of a 4-terminal device equipped with dual capacitors of the present application can break through the bottleneck of the conventional drive-switch-compensation scheme using the 3-terminal devices, and thus a new compensation scheme is provided.

BRIEF DESCRIPTION OF THE DRAWINGS

In order to illustrate schemes in embodiments of the present application or in the existing technologies more clearly, the following will briefly introduce the drawings that need to be used for describing the embodiments or exemplary technologies. Obviously, the drawings in the following description are merely some embodiments of the present application, and for those of ordinarily skills in the art, other drawings may also be obtained according to these drawings without any creative effort.

DETAILED DESCRIPTION OF THE EMBODIMENTS

In order to make the objectives, solutions and beneficial effects of the present application more comprehensible, the present application will be further described in detail below with reference to the drawings and embodiments. It should be understood that the specific embodiments described herein are only used to explain the present application, but not to limit the present application.

In addition, the terms "first" and "second" are only used for descriptive purposes, and should not be construed as indicating or implying relative importance or implying the number of the feature indicated. Thus, a feature defined as "first" or "second" may expressly or implicitly include one or more of that feature. In the description of the present application, the phrase "a/the plurality of" means two or more, unless otherwise expressly and specifically defined. It should be noted that the pixel drive circuit, display panel and display device disclosed in the present application may be used in the field of display technology, and may also be used in any field other than the field of display technology. The application field of the pixel drive circuit, display panel and display device disclosed in the present application will not be limited here.

Figure 1:
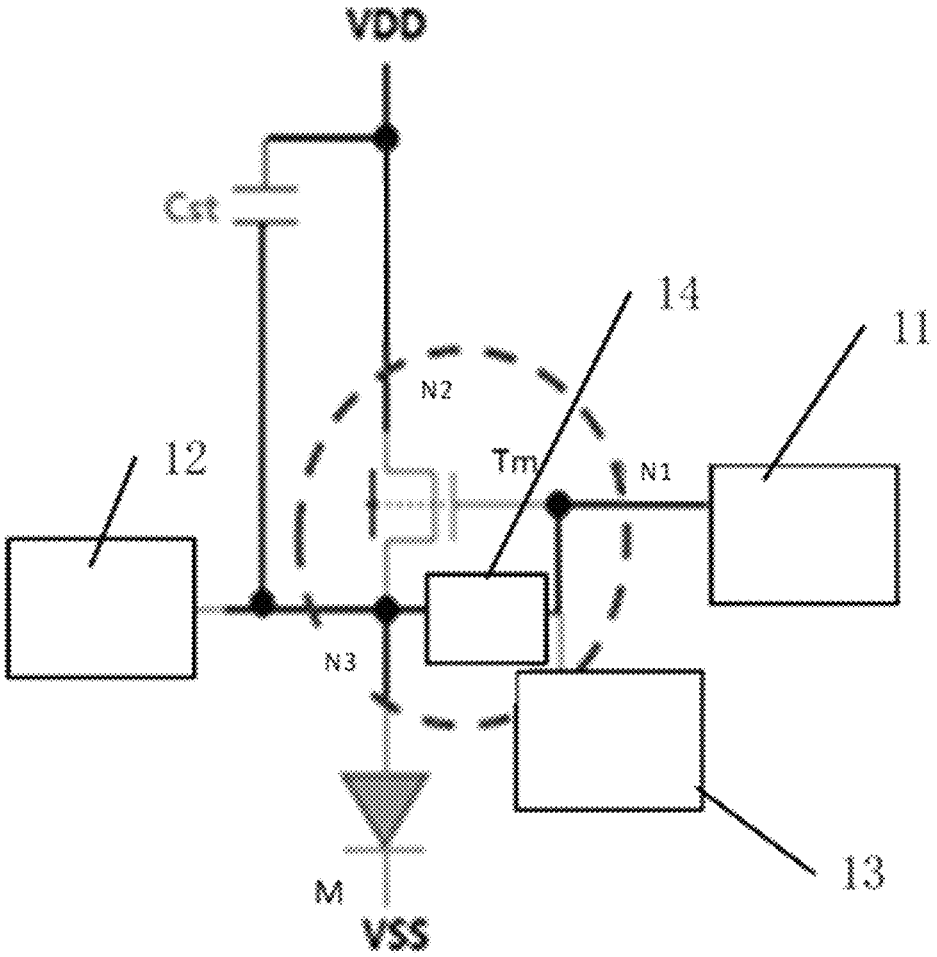
FIG. 1 is a schematic block diagram of a pixel drive circuit in accordance with an embodiment of the present application.

FIG. 1 is a schematic structural diagram of a pixel drive circuit provided by an embodiment of the present application. As shown in FIG. 1, the pixel drive circuit includes a drive circuitry, a data-writing circuitry 11 and a compensation circuitry 14. The drive circuitry includes a drive transistor Tm and a storage capacitor Cst. The drive transistor Tm includes an input end, an output end, a first control end m11 and a second control end m12. The input end of the drive transistor Tm is coupled to a drive-voltage terminal, the output end of the drive transistor Tm is coupled to a sub-pixel element M, one end of the storage capacitor Cst is coupled to the drive-voltage terminal VDD, and the other end of the storage capacitor Cst is coupled to the output end of the drive transistor Tm. An output end of the data-writing circuitry 11 is coupled to the first control end m11 of the drive transistor Tm. The data-writing circuitry 11 is configured to write a data voltage to the first control end m11 of the drive transistor Tm in a writing phase.

The compensation circuitry 14 includes two compensation elements. One of the two compensation elements is coupled between the output end and the first control end m11 of the drive transistor Tm, and is configured to compensate a potential at the first control end of the drive transistor Tm.

The other one of the two compensation elements is coupled between the output end and the second control end m12 of the drive transistor Tm, and is configured to compensate a potential at the second control end m12 of the drive transistor Tm.

Figure 2:
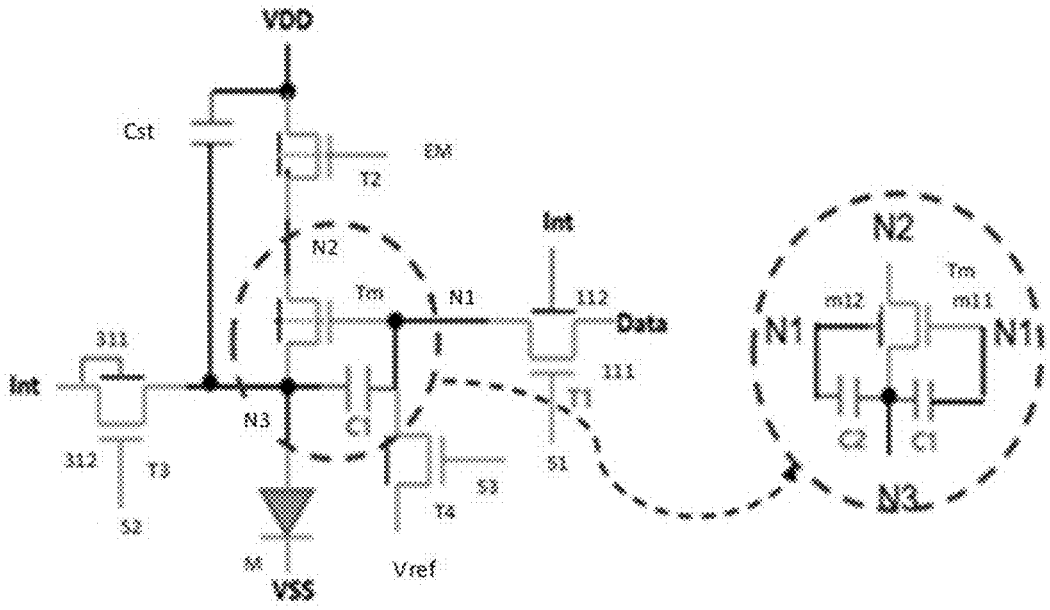
FIG. 2 is a schematic diagram of a detailed structure of the pixel drive circuit in accordance with an embodiment of the present application.

Referring to FIG. 2, in an optional embodiment, each compensation element includes a compensation capacitor (C1, C2 in FIG. 2). In one compensation element, one end of the compensation capacitor C1 is coupled to the output end of the drive transistor Tm, and the other end of the compensation capacitor C1 is coupled to the first control end m11 of the drive transistor Tm. In the other compensation element, one end of the compensation capacitor C2 is coupled to the output end of the drive transistor Tm, and the other end of the compensation capacitor C2 is coupled to the second control end m12 of the drive transistor Tm.

In an embodiment of the present application, the above-mentioned pixel drive circuit is applied to a display panel, and the display panel includes a plurality of pixel elements, and each pixel element may be a red pixel element, a blue pixel element or a green pixel element, that is, a red sub-pixel, a blue sub-pixel, and a green sub-pixel. Generally, three pixel elements constitute a pixel, which is the smallest integrated unit that constitutes a pixel arrangement structure. The pixel arrangement structure constitutes a display area of the display panel, that is, the pixel arrangement includes a plurality of pixels arranged in a specific arrangement, and each pixel includes a plurality of pixel elements, such as red pixel elements, blue pixel elements and green pixel elements, each pixel element is electrically connected to a driver IC (integrated circuit) through an independent drive line, and the pixel elements in the pixel are powered on by a driving of the driver IC to emit colored light.

It should be noted that, in the present application, the pixel elements in one pixel may include a red pixel element, a blue pixel element and a green pixel element, and the number of pixel elements in one pixel may be three or four, which will not be limited herein.

In case that the number of pixel elements in one pixel is three, the three pixel elements are generally a red pixel element, a blue pixel element and a green pixel element. In case that the number of pixel elements is four, the colors of the four pixel elements may respectively include: red, blue, green, and one other color. The other color may be different from red, blue, and green, such as white, yellow, or cyan. It should be noted that, if the other color is white, the display brightness of the display device where the pixel arrangement is located can be improved. If the other color is other colors, the color gamut of the display device can be increased, which is not limited here.

In the exemplary technology, an operation process of the pixel drive circuit includes a reset phase, a compensation phase, a writing phase, and a light-emitting phase. In the operation process of this circuit structure, the operation of the drive transistor Tm is critical. In the existing technology, the threshold voltage of each drive transistor Tm is different due to the limitations of the manufacturing process of the drive transistor Tm, that is, the switch-on current through the channel is different. the influence on the threshold voltage of a conductive channel formed by the device itself may be eliminated through an internal compensation circuit. However, the conventional drive-switch-compensation scheme using 3-terminal devices has been developed to a certain extent, resulting in an insurmountable bottleneck. Thus, the above compensation scheme is provided by the present application. The drive transistor Tm is configured as a 4-terminal drive device having two control ends, and a compensation element is arranged between each control end and the output end, so that threshold voltages of the front and rear channels are compensated simultaneously when the drive transistor Tm is driven. Meanwhile each control end is equipped with a capacitor to eliminate a current difference caused by the threshold voltage of a secondary channel in the 4-terminal device, the configuration scheme of a 4-terminal device equipped with dual capacitors of the present application can break through the bottleneck of the conventional drive-switch-compensation scheme using the 3-terminal devices, and thus a new compensation scheme is provided.

It can be understood that the transistors of the present application may be thin-film transistors (TFTs). In an exemplary embodiment, some devices in the pixel drive circuit may be arranged in a non-display area of the display panel, and thus the transistors may also be other types of transistors in some implementations, which will not be limited in here.

In an optional embodiment, the data-writing circuitry 11 includes a data-writing control transistor T1, and the data-writing control transistor T1 includes an input end, an output end and a control end. The input end of the data-writing control transistor T1 is coupled to a data-voltage terminal DATA, the output end of the data-writing control transistor T1 is coupled to the first control end of the drive transistor Tm, and the control end of the data-writing control transistor T1 is coupled to a first gate-control-signal line S1. In this embodiment, the data-writing control transistor is a 3-terminal device, and through the data-writing control transistor, the timing when the data voltage is written to the control end of the drive transistor can be controlled.

In a preferred embodiment, the data-writing control transistor may also be a 4-terminal device, that is, the data-writing circuitry includes a data-writing control transistor T1, and the data-writing control transistor T1 includes an input end, an output end, a first control end 111 and a second control end 112. The input end of the data-writing control transistor T1 is coupled to the data-voltage terminal DATA, the output end of the data-writing control transistor T1 is coupled to the first control end m11 of the drive transistor Tm, the first control end 111 of the data-writing control transistor T1 is coupled to the first gate-control-signal line S1, and the second control end 112 of the data-writing control transistor T1 is coupled to a DC-voltage line Int.

The data-writing control transistor T1 is configured to control the timing when the data-voltage line is written to the control end of the drive transistor, and then the data voltage written to the control end of the drive transistor can be controlled through a conduction of the data-writing control transistor (i.e., gate-control-signal line) during the reset, compensation, writing and light-emitting phases. On the other hand, the second control end of the data-writing control transistor is coupled to the reference-voltage line, and thus a reset operation is completed through a reference voltage.

In an optional embodiment, the pixel drive circuit also includes an input control transistor T2. A control end of the input control transistor T2 is coupled to an emission-signal line EM, an input end of the input control transistor T2 is coupled to the drive-voltage terminal VDD, and an output end of the input control transistor T2 is coupled to the input end of the drive transistor Tm, thereby enabling the input end of the drive transistor Tm is coupled to the drive-voltage terminal VDD. The timing at which the drive voltage is written into the drive transistor Tm can be controlled by the input control transistor T2, so that different phases can be switched.

In an optional embodiment, the pixel drive circuit also includes a reset circuitry 12. The reset circuitry is configured, in response to a reset-response voltage output from a reset-response-voltage line to pull down a voltage at one end of the storage capacitor that is coupled to the output end of the drive transistor Tm to a reset voltage. In this embodiment, the reset circuitry may pull down a potential at the node N3, that is, the output end of the drive transistor Tm, to the reset voltage in the reset phase, so that an initial state can be restored before the next light-emitting phase.

In an optional embodiment, the reset circuitry includes a reset transistor T3. A control end of the reset transistor T3 is coupled to a second gate-control-signal line Gn-2, an input end of the reset transistor T3 is coupled to a reset-voltage terminal (an output end of a reset-signal line Int), and an output end of the reset transistor T3 is coupled to the output end of the drive transistor Tm.

Alternatively, the reset transistor may also be a 4-terminal device. The reset circuitry includes a reset transistor T3, and the reset transistor T3 includes two control ends, one control end 311 and an input end of the reset transistor T3 are both coupled to a reset-voltage line, the other control end 312 of the reset transistor T3 is coupled to the second gate-control-signal line S2, and an output end of the reset transistor T3 is coupled to the output end of the drive transistor Tm.

In an optional embodiment, also referring to FIG. 1, the pixel drive circuit also includes a flip-elimination circuitry 13. As shown in FIG. 2, the flip-elimination circuitry includes a flip-elimination transistor T4, a control end of the flip-elimination transistor T4 is coupled to a third gate-control-signal line S3, an input end of the flip-elimination transistor T4 is coupled to a reference-voltage terminal, and an output end of the flip-elimination transistor T4 is coupled to the control end of the drive transistor Tm. The flip-elimination transistor T4 is configured to write to a reference voltage to the control end of the drive transistor Tm before the writing phase.

In this embodiment, the flip-elimination circuitry 11 is configured, the reference voltage Vref can be written to the control end of the drive transistor Tm through the independent circuit line in the compensation phase, it thus is unnecessary to write the reference voltage Vref through a data-voltage line before each writing of the data voltage. In the writing phase of the data voltage, the entire time of each writing can be used for the writing of the data voltage without reserving half of the time for writing the reference voltage Vref, so that the level switch frequency of the data line does not need to reach twice the normal light-emitting frequency, which reduces the burden on the display panel, greatly reduces the power consumption of the screen, and improves product competitiveness.

It can be understood that the transistor in the present application generally includes a control end, an input end, and an output end. Correspondingly, the control end is the gate of the transistor, and the input end and the output end are the source and drain of the transistor, respectively.

In addition, it is defined that the input end is a signal input end, the output end is a signal output end, and the control end is an end that controls whether the input signal passes through. For example, in FIG. 2, the input end of the drive transistor should be the end coupled to the drive-voltage terminal, and the drive voltage is derived from the input end to the output end, i.e., the output end of the drive transistor is coupled to the sub-pixel element.

Figure 3:
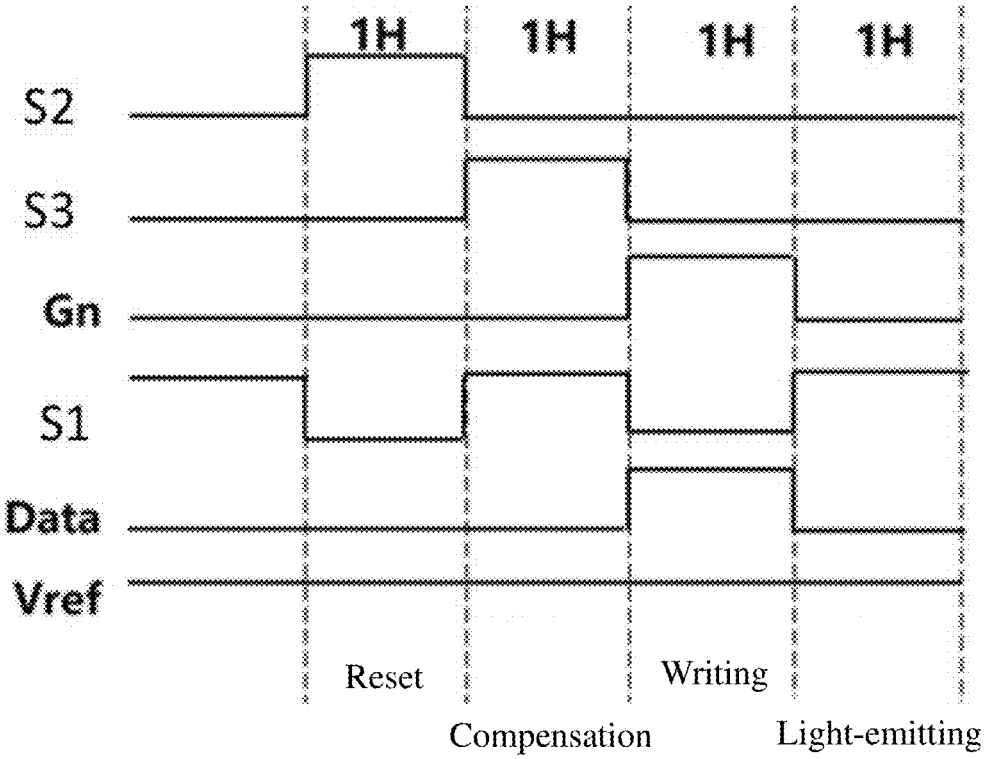
FIG. 3 is a schematic diagram of a time-sequence control corresponding to FIG. 2.
Figure 4:
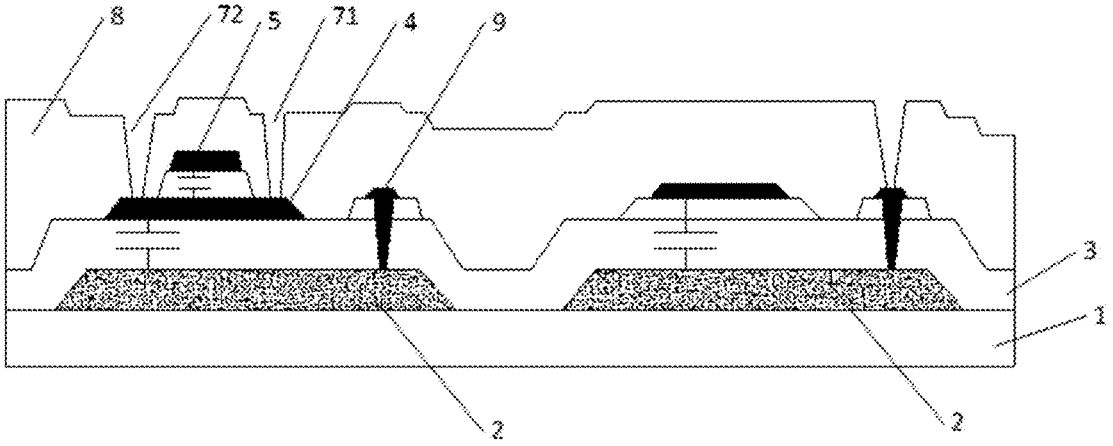
FIG. 4 is a schematic diagram of a layer structure of the drive switch in FIG. 1.

As shown in FIG. 4, the drive transistor Tm in the present application includes a first control end, an input end and an output end, and the drive switch in the present application also includes a second control end. As shown in FIG. 3, the drive switch includes: a substrate 1; a first metal layer 2 formed on one side surface of the substrate 1; an active layer 4 formed on a side of the first metal layer 2 away from the substrate 1; and a transistor structure located on a side of the active layer 4 away from the first metal layer 2. The transistor structure includes a gate constituted by the second metal layer 5, and a source (formed by depositing metal in a via hole 72 in FIG. 4) and a drain (formed by depositing metal in a via hole 71 in FIG. 4) located on two sides of the second metal layer 5, and in electrical connection with the active layer 4. The first metal layer is coupled to the source or drain as an output end through a wire.

In the embodiment of the present application, the first metal layer 2 is formed on the surface of one side of the substrate 1, and the first metal layer 2 constitutes a bottom gate of the thin film transistor in the embodiment of the present application. The bottom gate may be electrically connected to an external wire through conductive metal 9 deposited in the via hole, for example, an end of the wire is soldered to the conductive metal on the via hole.

The active layer is formed on the side of the first metal layer 2 away from the substrate 1, that is, the active layer is located above the first metal layer 2, and during specific fabrication, a buffer layer 3 may be arranged between the active layer 4 and the first metal layer 2, which on the one hand, plays the role of electrical isolation, and on the other hand provides certain mechanical support and buffering.

The second metal layer 5 is formed above the active layer 4, the second metal layer 5 constitutes a top gate of the thin film transistor, and a gate insulation film (GI) layer 6 may be disposed between the second metal layer 5 and the active layer 4.

In addition, an interlayer dielectric 8 is deposited on the active layer 4, and then the interlayer dielectric 8 is exposed and masked, a pair of via holes 71 and 72 may be formed on the active layer, and then metal is deposited on the via holes 71 and 72 to form the source and drain located on the two sides of the second metal layer 5 and in electrical connection with the active layer 4, whereby the transistor structure of the present application is formed, and specifically includes a source and a drain constituted by the metal deposited in the pair of via holes, and a gate constituted by the second metal layer. In principle, as the TFT of the present application is a 4-terminal device, a secondary channel is also formed opposite to the original channel. This secondary channel will also conduct current, and thus a current difference caused by the difference in threshold value of the channel is also existed, thus in the present application, the first capacitor and the second capacitor are provided to compensate the influence of the secondary channel, thereby the compensation effect to the threshold voltage of the 4-terminal device is improved, the uniformity of pixel brightness is improved, and the display taste is also improved.

It should also be understood that, in the present application, the drive transistor Tm may be a TFT of other structures, as long as the second control end is coupled to the DC-voltage terminal.

In the above embodiments, other transistors may also be the 4-terminal devices, which will not be limited in here.

The present application will be described in detail below with reference to the time-sequence diagram shown in FIG. 3.

Firstly, in the reset phase, the potential of the first gate-control-signal line is pulled low, the input control transistor is switched off, so that the light-emitting current of the sub-pixel element is disconnected. The potential of the second gate-control-signal line is pulled high, the reset transistor is switched on, the compensation capacitor C1 included in the first compensation element and the compensation capacitor C1 included in the second compensation element are charged to the reference voltage 1, respectively; and then the potential of the second gate-control-signal line is pulled low to turn off the reset transistor T3. The potential of the third gate-control-signal line is pulled high, the voltage-stabilization transistor is switched on, the potential of the gate-control-signal line is pulled low, the data-writing control transistor is switched off, a potential at the node N3 is reset to the reference voltage 2, and the node N1 at one end of the compensation capacitor C1 included in the first compensation element is charged until the potential at the node N1 is reset to the reference voltage 2 (the reference voltage 2 ensures that the drive transistor Tm is switched on), and then the third gate-control-signal line is pulled low to turn off the voltage-stabilization transistor.

After that, in the compensation phase, the potential of the first gate-control-signal line is kept at a high level, so that the input control transistor remains at an on state. The drive voltage is written to the node N2. Since the voltage at the node N1 in the reset phase can ensure that the drive transistor is switched on, the node N3 can be charged through the node N2. Two charging paths are provided, namely, the main channel of the device controlled by the node N1 connected to the capacitor C1 and the secondary channel of the device controlled by the node N1 connected to the capacitor C2, and under the charging action of the main and secondary channels, the potential at the node N3 is raised to V (N1)−Vth (Tm). The Vth (Tm) is equivalent to the threshold voltage, that is, the threshold voltage Vth of the drive transistor Tm is stored in the capacitor C1, the acquisition operation of the Tm threshold voltage is completed.

And then, in the writing phase, the potentials of the gate-control-signal line and the data-voltage line are at a high level, the data-writing control transistor is switched on, and the compensation capacitor C1 included in the first compensation element is charged at this time, after the compensation capacitor C1 included in the first compensation element is fully charged, the data voltage is written to the node N1.

Finally, in the light-emitting phase, the second gate-control-signal line and the third gate-control-signal line are both switched to a low potential, the reset transistor and the voltage-stabilization transistor are switched off, the potential at the node N1 is maintained to keep the drive transistor at the on state. The potentials of the first gate-control-signal line is pulled high to switch on the input control transistor, the drive voltage, passing through the input control transistor and the drive transistor, is input to the anode of the sub-pixel element, thereby providing holes for the sub-pixel element of the sub-pixel element, the holes recombine with the electrons transmitted from the cathode to emit light.

Those of ordinary skill in the art will understand that the "coupling" in this disclosure may be a direct or indirect electrical connection. For example, if A and B are coupled, A may be directly and electrically connected to B, or A may be electrically connected to B through C, which will not be limited here.

In an embodiment of the present application, a display panel 20 is provided, which includes the pixel drive circuit as above-described. The display panel includes a plurality of pixels, and the pixel drive circuit is coupled to the sub-pixel elements in each pixel through wires.

It can be understood that, in the display panel of the present application, the drive transistor included in the pixel drive circuit is configured as a four-terminal drive having two control ends, and between each control end and the output end, a compensation element is arranged, thereby the compensations to the threshold voltage of the front and rear channels are performed simultaneously when the drive transistor is driven, and each control end is equipped with a capacitor to eliminate the influence of the current difference caused by the threshold voltage of the secondary channel in the 4-terminal device. The configuration scheme of a 4-terminal device equipped with dual capacitors of the present application can break through the bottleneck of the conventional drive-switch-compensation scheme using the 3-terminal devices, and thus a new compensation scheme is provided.

Figure 5:
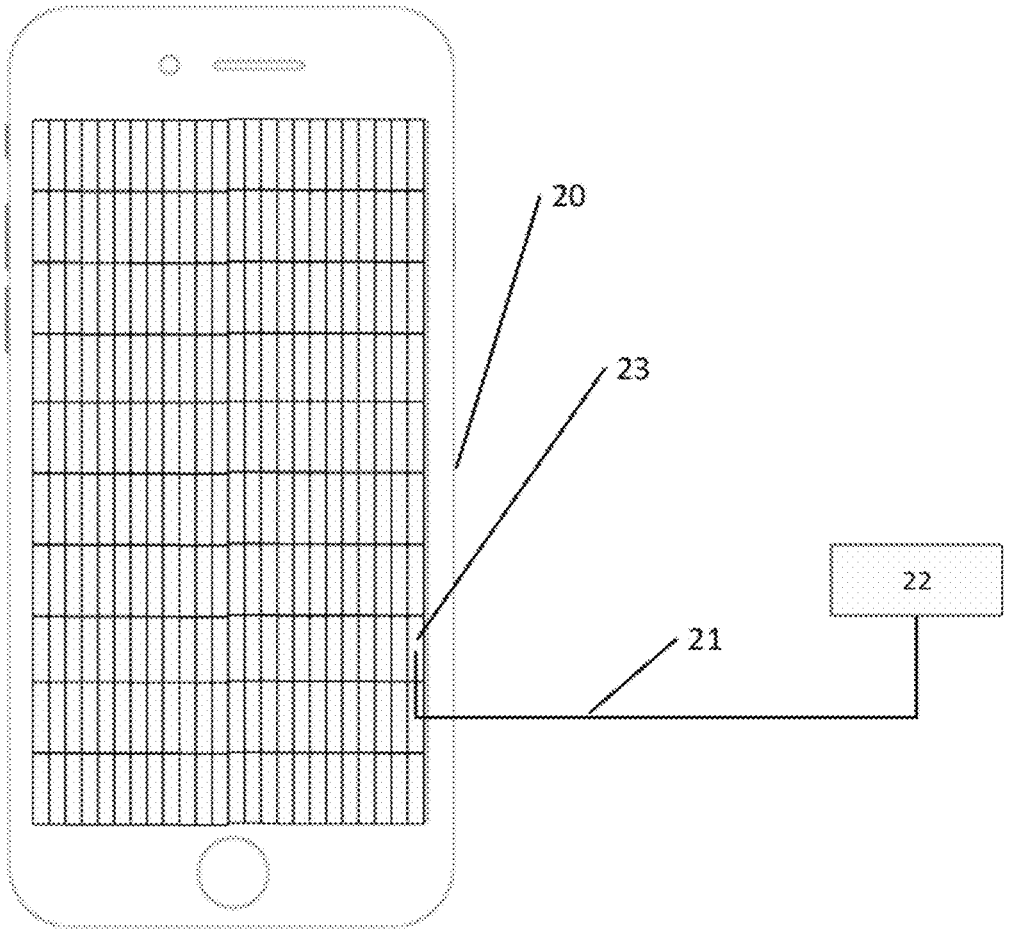
FIG. 5 is a schematic structural diagram of a display device in accordance with an embodiment of the present application.

As shown in FIG. 5, a display device 20 is provided by an embodiment of the present application, which includes the display panel and the pixel drive circuit 22 as above-described. The display panel includes a plurality of pixels, and the pixel drive circuit is coupled to the sub-pixel elements in each pixel through wires.

During a specific implementation, the display device provided by the embodiment of the present application may be any product or component having display function, such as a mobile phone, a tablet computer, a television, a monitor, a notebook computer, a digital photo frame, and a navigator.

It can be understood that, in the display device of the present application, the drive transistor is configured as a four-terminal drive device having two control ends, and between each control end and the output end, a compensation element is arranged, thereby the threshold-voltage compensations to the front and rear channels are performed simultaneously when the drive transistor is driven, meanwhile, each control end is equipped with a capacitor to eliminate the influence of the current difference caused by the threshold voltage of the secondary channel in the 4-terminal device. The configuration scheme of a 4-terminal device equipped with dual capacitors of the present application can break through the bottleneck of the conventional drive-switch-compensation scheme using the 3-terminal devices, and thus a new compensation scheme is provided.

In accordance with an embodiment of the present application, a driving method of a display device is also provided. The driving method is implemented through the pixel drive circuit as above-described, steps of the driving method of the present application are described in detail below with reference to the embodiments of FIG. 2 and FIG. 3.

FIG. 3 is a time-sequence diagram corresponding to the embodiment of FIG. 2. As shown in FIG. 3, the entire process may include four phases. The pixel drive method includes steps of: charging the first compensation element and the second compensation element through the input end of the drive transistor, in the compensation phase, to raise the potential at the output end of the drive transistor to a difference between the potential at the control end of the drive transistor and the threshold voltage of the drive transistor; and switching on the drive transistor to form a conduction between the drive-voltage terminal and the sub-pixel element, in the light-emitting phase, to drive the sub-pixel element to emit light.

The pixel drive method of the present application will be described in detail below with reference to FIG. 3.

Firstly, in the reset phase, the potential of the first gate-control-signal line is pulled low, the input control transistor is switched off, so that the light-emitting current of the sub-pixel element is disconnected. The potential of the second gate-control-signal line is pulled high, the reset transistor is switched on, the compensation capacitor C1 included in the first compensation element and the compensation capacitor C1 included in the second compensation element are charged to the reference voltage 1, respectively; and then the potential of the second gate-control-signal line is pulled low to turn off the reset transistor T3. The potential of the third gate-control-signal line is pulled high, the voltage-stabilization transistor is switched on, the potential of the gate-control-signal line is pulled low, the data-writing control transistor is switched off, a potential at the node N3 is reset to the reference voltage 2, and the node N1 at one end of the compensation capacitor C1 included in the first compensation element is charged until the potential at the node N1 is reset to the reference voltage 2 (the reference voltage 2 ensures that the drive transistor Tm is switched on), and then the third gate-control-signal line is pulled low to turn off the voltage-stabilization transistor.

Then, in the compensation phase, the potential of the first gate-control-signal line is kept at a high level, so that the input control transistor remains at an on state. The drive voltage is written to the node N2. Since the voltage at the node N1 in the reset phase can ensure that the drive transistor is switched on, the node N3 can be charged through the node N2. Two charging paths are provided, namely, the main channel of the device controlled by the node N1 connected to the capacitor C1 and the secondary channel of the device controlled by the node N1 connected to the capacitor C2, and under the charging action of the main and secondary channels, the potential at the node N3 is raised to V (N1)−Vth (Tm). The Vth (Tm) is equivalent to the threshold voltage, that is, the threshold voltage Vth of the drive transistor Tm is stored in the capacitor C1, the acquisition operation of the Tm threshold voltage is completed.

After that, in the writing phase, the potentials of the gate-control-signal line and the data-voltage line are at a high level, the data-writing control transistor is switched on, and the compensation capacitor C1 included in the first compensation element is charged at this time, after the compensation capacitor C1 included in the first compensation element is fully charged, the data voltage is written to the node N1.

Finally, in the light-emitting phase, the second gate-control-signal line and the third gate-control-signal line are both switched to a low potential, the reset transistor and the voltage-stabilization transistor are switched off, the potential at the node N1 is maintained to keep the drive transistor at the on state. The potentials of the first gate-control-signal line is pulled high to switch on the input control transistor, the drive voltage, passing through the input control transistor and the drive transistor, is input to the anode of the sub-pixel element, thereby providing holes for the sub-pixel element of the sub-pixel element, the holes recombine with the electrons transmitted from the cathode to emit light.

It can be seen from the above solutions that in the driving method provided by the embodiments of the present application, the drive transistor is configured as a four-terminal drive device having two control ends, and between each control end and the output end, a compensation element is arranged, thereby the compensations to the threshold voltage of the front and rear channels are performed simultaneously when the drive transistor is driven, meanwhile, each control end is equipped with a capacitor to eliminate the influence of the current difference caused by the threshold voltage of the secondary channel in the 4-terminal device. The configuration scheme of a 4-terminal device equipped with dual capacitors of the present application can break through the bottleneck of the conventional drive-switch-compensation scheme using the 3-terminal devices, and thus a new compensation scheme is provided.

It should be noted that, the embodiments of the drive circuit, the embodiments of the display device, and the embodiments of the driving method and the debugging method provided by the present application may all refer to each other, which will not be limited to the embodiments of the present application. Steps of the method for manufacturing the display panel provided by the embodiments of the present application can be correspondingly increased or decreased according to actual situations. Variations of these methods, that can be easily conceived by those skilled artists who are familiar with the field disclosed in the present application, should all be covered within the protection scope of the present application, which will not be further described in the present application.

The above descriptions are merely optional embodiments of the present application, and are not intended to limit the present application. Any modifications, equivalent replacements, improvements, etc. made within the fundamental and principles of the present application shall be included within the protection scope of the present application.

What is claimed is:

1. A pixel drive circuit, applied to a display panel, the display panel comprising a plurality of pixels, each pixel comprising a plurality of sub-pixel elements, and the pixel drive circuit comprising:

a drive circuitry, comprising:

a drive transistor having an input end, an output end, a first control end and a second control end, wherein the input end of the drive transistor is coupled to a drive-voltage terminal, and the output end of the drive transistor is coupled to one of the plurality of sub-pixel elements; and a storage capacitor, one end of the storage capacitor coupled to the drive-voltage terminal, and another end of the storage capacitor coupled to the output end of the drive transistor;

a data-writing circuitry, an output end of the data-writing circuitry coupled to the first control end of the drive transistor, wherein the data-writing circuitry is configured to write a data voltage to the first control end of the drive transistor in a writing phase; and compensation circuitry, comprising two compensation elements, wherein one of the two compensation elements is coupled between the output end and the first control end of the drive transistor, to compensate a potential at the first control end of the drive transistor, and the other one of the two compensation elements is coupled between the output end and the second control end of the drive transistor, to compensate a potential at the second control end of the drive transistor.

2. The pixel drive circuit according to claim 1, wherein the pixel drive circuit further comprises a reset circuitry, and the reset circuitry is configured, in response to a reset-response voltage output from a reset-response-voltage line, to pull down a voltage at one end of the storage capacitor coupled to the output end of the drive transistor Tm to a reset voltage.

3. The pixel drive circuit according to claim 2, wherein the reset circuitry comprises a reset transistor, a control end of the reset transistor is coupled to a second gate-control-signal line, an input end of the reset transistor is coupled to a reset-voltage line, and an output end of the reset transistor is coupled to the output end of the drive transistor;

or, alternatively, the reset circuitry comprises a reset transistor having two control ends, one control end and an input end of the reset transistor are coupled to the reset-voltage line, the other control end of the reset transistor is coupled to the second gate-control-signal line, and an output end of the reset transistor is coupled to the output end of the drive transistor.

4. The pixel drive circuit according to claim 1, wherein each of the two compensation elements comprises a compensation capacitor, the compensation capacitor included in one of the two compensation elements has one end coupled to the output end of the drive transistor, and another end coupled to the first control end of the drive transistor, and the compensation capacitor included in the other one of the two compensation element has one end coupled to the output end of the drive transistor, and another end coupled to the second control end of the drive transistor.

5. The pixel drive circuit according to claim 1, wherein the data-writing circuitry comprises a data-writing control transistor, and the data-writing control transistor has an input end, an output end and a control end, the control end of the data-writing control transistor is coupled to a first gate-control-signal line, the input end of the data-writing control transistor is coupled to a data-voltage terminal, and the output end of the data-writing control transistor is coupled to the first control end of the drive transistor.

6. The pixel drive circuit according to claim 1, wherein the data-writing circuitry comprises a data-writing control transistor, and the data-writing control transistor has an input end, an output end, a first control end and a second control end, the input end of the data-writing control transistor is coupled to the data-voltage terminal, and the output end of the data-writing control transistor is coupled to the first control end of the drive transistor, the first control end of the data-writing control transistor is coupled to the first gate-control-signal line, and the second control end of the data-writing control transistor is coupled to a DC-voltage line.

7. The pixel drive circuit according to claim 1, wherein the pixel drive circuit further comprises an input control transistor, and a control end of the input control transistor is coupled to an emission-signal line, an input end of the input control transistor is coupled to the drive-voltage terminal, an output end of the input control transistor is coupled to the input end of the drive transistor, so that the input end of the drive transistor is coupled with the drive-voltage terminal.

8. The pixel drive circuit according to claim 1, wherein the pixel drive circuit further comprises a flip-elimination circuitry comprising a flip-elimination transistor, a control end of the flip-elimination transistor is coupled to a third gate-control-signal line, an input end of the flip-elimination transistor is coupled to a reference-voltage terminal, and an output end of the flip-elimination transistor is coupled to the control end of the drive transistor, and wherein the flip-elimination transistor is configured to write a reference voltage to the control end of the drive transistor before the writing phase.

9. A display panel, comprising:

a plurality of pixels, each pixel comprising a plurality of sub-pixel elements; and a pixel drive circuit, comprising:

a drive circuitry, comprising:

a drive transistor, having an input end, an output end, a first control end and a second control end, wherein the input end of the drive transistor is coupled to a drive-voltage terminal, and the output end of the drive transistor is coupled to one of the plurality of sub-pixel elements; and a storage capacitor, one end of the storage capacitor coupled to the drive-voltage terminal, and another end of the storage capacitor coupled to the output end of the drive transistor;

a data-writing circuitry, an output end of the data-writing circuitry coupled to the first control end of the drive transistor, wherein the data-writing circuitry is configured to write a data voltage to the first control end of the drive transistor in a writing phase; and compensation circuitry comprising two compensation elements, wherein one of the two compensation elements is coupled between the output end and the first control end of the drive transistor to compensate a potential at the first control end of the drive transistor, and the other one of the two compensation elements is coupled between the output end and the second control end of the drive transistor, to compensate a potential at the second control end of the drive transistor.

10. The display panel according to claim 9, wherein the pixel drive circuit further comprises a reset circuitry, and the reset circuitry is configured, in response to a reset-response voltage output from a reset-response-voltage line, to pull down a voltage at one end of the storage capacitor coupled to the output end of the drive transistor Tm to a reset voltage.

11. The display panel according to claim 10, wherein the reset circuitry comprises a reset transistor, a control end of the reset transistor is coupled to a second gate-control-signal line, an input end of the reset transistor is coupled to a reset-voltage line, and an output end of the reset transistor is coupled to the output end of the drive transistor;

or, alternatively, the reset circuitry comprises a reset transistor having two control ends, one control end and an input end of the reset transistor are coupled to the reset-voltage line, the other control end of the reset transistor is coupled to the second gate-control-signal line, and an output end of the reset transistor is coupled to the output end of the drive transistor.

12. The display panel according to claim 9, wherein each of the two compensation elements comprises a compensation capacitor, the compensation capacitor included in one of the two compensation elements has one end coupled to the output end of the drive transistor, and another end coupled to the first control end of the drive transistor, and the compensation capacitor included in the other one of the two compensation element has one end coupled to the output end of the drive transistor, and another end coupled to the second control end of the drive transistor.

13. The display panel according to claim 9, wherein the data-writing circuitry comprises a data-writing control transistor, and the data-writing control transistor has an input end, an output end and a control end, the control end of the data-writing control transistor is coupled to a first gate-control-signal line, the input end of the data-writing control transistor is coupled to a data-voltage terminal, and the output end of the data-writing control transistor is coupled to the first control end of the drive transistor.

14. The display panel according to claim 9, wherein the data-writing circuitry comprises a data-writing control transistor, and the data-writing control transistor has an input end, an output end, a first control end and a second control end, the input end of the data-writing control transistor is coupled to the data-voltage terminal, and the output end of the data-writing control transistor is coupled to the first control end of the drive transistor, the first control end of the data-writing control transistor is coupled to the first gate-control-signal line, and the second control end of the data-writing control transistor is coupled to a DC-voltage line.

15. The display panel according to claim 9, wherein the pixel drive circuit further comprises an input control transistor, a control end of the input control transistor is coupled to an emission-signal line, an input end of the input control transistor is coupled to the drive-voltage terminal, an output end of the input control transistor is coupled to the input end of the drive transistor so that the input end of the drive transistor is coupled with the drive-voltage terminal.

16. The display panel according to claim 9, wherein the pixel drive circuit further comprises a flip-elimination circuitry comprising a flip-elimination transistor, a control end of the flip-elimination transistor is coupled to a third gate-control-signal line, an input end of the flip-elimination transistor is coupled to a reference-voltage terminal, and an output end of the flip-elimination transistor is coupled to the control end of the drive transistor, and wherein the flip-elimination transistor is configured to write a reference voltage to the control end of the drive transistor before the writing phase.

17. A display device, comprising a display panel, comprising:

a plurality of pixels, each pixel comprising a plurality of sub-pixel elements; and a pixel drive circuit comprising:

a drive circuitry, comprising:

a drive transistor, having an input end, an output end, a first control end and a second control end, wherein the input end of the drive transistor is coupled to a drive-voltage terminal, and the output end of the drive transistor is coupled to one of the plurality of sub-pixel elements; and a storage capacitor, one end of the storage capacitor coupled to the drive-voltage terminal, and another end of the storage capacitor coupled to the output end of the drive transistor;

a data-writing circuitry, an output end of the data-writing circuitry coupled to the first control end of the drive transistor, wherein the data-writing circuitry is configured to write a data voltage to the first control end of the drive transistor in a writing phase; and compensation circuitry, comprising two compensation elements, wherein one of the two compensation elements is coupled between the output end and the first control end of the drive transistor, to compensate a potential at the first control end of the drive transistor, and the other one of the two compensation elements is coupled between the output end and the second control end of the drive transistor, to compensate a potential at the second control end of the drive transistor.

* * * * *